United States Patent [19]

Trickel et al.

[11] Patent Number: 4,597,810

[45] Date of Patent: Jul. 1, 1986

[54] TRACER UNIT FOR AMMUNITION

[76] Inventors: Neal E. Trickel, 1911 10th St.; Sherwood V. Strommen, P.O. Box 111, both of Monroe, Wis. 53566

[21] Appl. No.: 747,051

[22] Filed: Jun. 20, 1985

[51] Int. Cl.[4] ..... C06B 45/14

[52] U.S. Cl. ..... 149/15; 149/40; 149/41; 149/43; 149/61; 86/20 B; 102/513

[58] Field of Search ..... 102/513; 86/1 R, 20 R, 86/20 B; 29/1.2, 1.3; 149/37, 40, 41, 43, 61, 15

[56] References Cited

U.S. PATENT DOCUMENTS

| | | | |
|---|---|---|---|
| 3,886,009 | 5/1975 | Puchalski | 149/44 |
| 3,930,844 | 1/1976 | Parrish et al. | 149/124 |
| 3,982,930 | 9/1976 | Doades et al. | 149/124 |
| 4,130,061 | 12/1978 | Boggs et al. | 149/19.91 |

*Primary Examiner*—Stephen J. Lechert, Jr.

*Attorney, Agent, or Firm*—Glenn A. Buse

[57] ABSTRACT

The tracer unit, which is particularly adaptable for ammunition used in hand guns and submachine guns, consists of a base charge including about 70 to about 90 weight % strontium peroxide, about 5 to about 15 weight % calcium resinate and about 5 to about 10 weight % magnesium and an igniter charge covering the base charge and including about 40 to about 60 weight % calcium resinate, about 20 to about 30 weight % strontium nitrate and about 20 to about 30 weight % magnesium. A small cavity in the rear end of a projectile is partially filled with the base charge which is tamped into the cavity by the application of a low pressure, such as by hand tamping with a metal plunger or the like. The igniter charge is added to the projectile cavity on top of the base charge and, after drying, the exposed surface of the igniter charge is covered with a compatible moisture proofing material, such as shellac.

11 Claims, No Drawings

TRACER UNIT FOR AMMUNITION

This invention relates to ammunition including a tracer unit for illuminating the trajectory of the projectile and, in one aspect, to tracer units for small arms ammunition such as ammunition for hand guns and submachine guns and methods for loading same.

Ammunition including a tracer unit is used to illuminate the trajectory of the bullet or projectile after being fired from a weapon. Such ammunition is particularly valuable to military and law enforcement agencies for training purposes. A shooter can visually observe the projectile in flight and thereby obtain a "feel" for the velocity and ballistic characteristics of the particular caliber firearm being used.

Prior tracer compositions have one or more of the following shortcomings: (1) utilize ingredients which tend to foul and/or corrode the weapon bore, (2) produce toxic gases when ignited, (3) require a hydraulic ram or the like to produce pressures ranging anywhere from approximately 30,000 to 150,000 p.s.i. for loading, (4) require controlled environmental conditions during loading and/or storage, and (5) include relatively expensive ingredients.

Representative prior tracer compositions are disclosed in the following United States Patents:

| Patentee | Pat. No. | Issue Date |
|---|---|---|
| Meek | 1,756,255 | April 29, 1930 |
| Hart et al. | 2,700,603 | January 25, 1955 |
| Heiskell | 2,976,136 | March 21, 1961 |
| Doris | 3,677,842 | July 18, 1972 |
| Lehikoinen | 3,788,907 | January 29, 1974 |
| Puchalski | 3,886,009 | May 27, 1975 |
| Parrish at al. | 3,930,844 | January 6, 1976 |
| Doades et al. | 3,982,930 | September 28, 1976 |

The tracer compositions disclosed in these patents have one or more of the above-noted shortcomings.

SUMMARY OF THE INVENTION

An object of the invention is to provide a tracer unit for ammunition, particularly ammunition for small arms such as hand guns and submachine guns, which is non-corrosive.

Another object of the invention is to provide such a tracer unit which does not cause fouling or produce toxic gases.

A further object of the invention is to provide such a tracer unit which can be loaded by very low pressures, such as by hand tamping, without the need for special tools and/or equipment.

A yet further object of the invention is to provide a simple method for loading ammunition with a tracer unit.

Other objects, aspects and advantages of the invention will become apparent to those skilled in the art upon reviewing the following detailed description and the appended claims.

The invention provides a tracer unit comprising a base charge including about 75 to 90 weight % strontium peroxide, about 5 to about 15 weight % calcium resinate and about 5 to about 10 weight % magnesium and an igniter charge covering the base charge and including about 40 to about 60 weight % calcium resinate, about 20 to about 30 weight % strontium nitrate and about 20 to about 30 weight % magnesium. While inexpensive to produce, this tracer unit can be conveniently loaded with very low pressures, for example by hand, is non-corrosive and does not produce fouling or toxic gases upon burning. The weight ratio of the igniter charge to the base charge preferably is about 1:4 to about 1:20.

For loading, an anhydrous solvent is mixed with separate base and igniter charges to form moistened mixtures thereof and a small cavity in the rear end of the ammunition projectile first is partially filled with a sufficient amount of the damp base charge to illuminate the trajectory of the projectile for a desired portion of its flight when the weapon is fired. The damp base charge is tamped into the projectile cavity by the application of a very low pressure, such as by hand tamping with a metal plunger or the like, and a sufficient amount of the igniter charge then is added to the projectile cavity. After the base and igniter charges have dried, the exposed surface of the igniter charge is coated with a compatible moisture proofing material.

DESCRIPTION OF THE PREFERRED EMBODIMENTS

While the tracer unit of the invention can be used in projectiles of ammunition for a wide variety of calibers and applications, it is particularly adaptable for use in ammunition for hand guns and submachine guns. For instance, it can be loaded into projectiles as small as 0.177 caliber up to 20 mm and larger.

As mentioned above, the base charge includes strontium peroxide, calcium resinate and magnesium. All the ingredients of both the base charge and the igniter charge are in the form of a finely divided powder, preferably less than about 100 U.S. mesh.

Strontium peroxide serves as an oxidizing agent or a source of oxygen to obtain an adequate, but controlled, burning and also provides a desirable red coloration which is more visible than many other colors. To best serve these functions, the amount of strontium peroxide used in the base charge preferably is about 75 to about 90, most preferably about 85, weight %. All weight percentages for the base charge and the igniter charge disclosed herein are based on the total weight of the dry ingredients in the respective charge.

Calcium resinate serves primarily as a binder for the other ingredients. The amount used in base charge preferably is about 5 to about 15, most preferably about 9, weight %. Amounts less than about 5 weight % provides poor binding and results in frequent "fallout" of the base charge from the projectile cavity during flight. On the other hand, amounts greater than about 15% interfere with ignition, slow down the rate of burning and add an excessive orange tint to the visual trace because of the amount of calcium present.

Magnesium is the fuel for the tracer unit and is readily oxidized to produce a substantial amount of heat and light. It provides the luminous quality of the tracer. It has been found that amounts of magnesium substantially smaller than that used in conventional tracer compositions permit the base charge to be loaded at a very low pressure as described in more detail below and yet produce sufficient burning to provide suitable tracer characteristics.

The amount of magnesium used in the base charge preferably is about 5 to about 10, most preferably about 6, weight %. Amounts less than about 5 weight % cause an undesirable delay in ignition of the base charge when the weapon is fired and produce a dim, flickering trace and frequently no visible trace. Amounts greater than 10 weight % cause the base charge to burn at higher temperatures, resulting in an increase in chamber pressure, an increase in the intensity of muzzle flash, a reduction in the visible distance of the trace during flight, and a lightening of the tracer color. Amounts of 20 weight % or more cause the base charge to burn almost instanteously, resulting in little or no trace.

As mentioned above, the igniter charge includes magnesium, strontium nitrate, and calcium resinate.

The igniter charge must provide a greater amount of heat upon burning in order to ensure reliable ignition of the base charge. Accordingly, the igniter charge includes a larger amount of magnesium than the base charge. The amount of magnesium used in the igniter charge preferably is about 20 to about 30, most preferably about 25, weight %.

Strontium nitrate serves as an oxidizing agent to support rapid burning of the igniter charge. The amount of strontium nitrate used in the igniter charge preferably is about 20 to about 30, most preferably about 25, weight %.

Calcium resinate serves two primary purposes in the igniter charge. It serves as a binder for the other ingredients and slows down the burning rate of the igniter charge to thereby minimize muzzle flash. To best serve these dual purposes, the amount of calcium resinate used in the igniter charge preferably is about 40 to about 60, most preferably about 50, weight %.

The tracer unit, made up of the base and igniter charges, is loaded into a small cavity in the rear end of the ammunition projectile prior to installing the shell. This projectile cavity can be formed in any suitable manner such as by drilling or the like.

The volume of the projectile cavity (primarily the depth because the width often is limited by the surface area available at the rear of the projectile) depends primarily on tne caliber size of the projectile and the desired length of the tracer (burn time) during flight. That is, for larger caliber projectiles requiring longer distance tracer, the projectile cavity must have a volume large enough to receive both an amount of the base charge required to produce adequate burning to provide a visible trace over the desired distance and an amount of the igniter charge sufficient to ignite the base charge between the time the weapon is fired and the projectile leaves the barrel.

For smaller caliber hand guns ammunition, a projectile cavity is made as wide as reasonably possible in order to maximize the surface area between the igniter charge and the base charge and thereby ensure ignition of the base charge during the short travel time in the barrel. Care should be taken not to make the projectile cavity so large that the projectile weight is reduced to a point where the projectile travels through the weapon barrel too rapidly for ignition of the base charge. As a guide, a cylindrical cavity in a 9 mm projectile usually has a diameter of about ¼ inch and a depth of about 3/16 inch.

The ratio of the igniter charge to the base charge will vary somewhat, depending on the caliber size of the projectile the width or diameter of the projectile cavity, and therefore the surface area between the igniter and base charges, the type of weapon being fired, and the amount of the base charge. The igniter charge should completely cover the base charge in order to ensure reliable ignition.

Excessive amounts of the igniter charge produces a noticable muzzle flash and increases chamber pressure. Generally, the weight ratio of the ignitor charge to the base charge is about 1:1 to about 1:20. As a guide, for smaller hand gun ammunition (e.g., 9 mm or 0.38 projectile) the weight ratio of the igniter charge to the base charge usually is about 1:9. For larger caliber ammunition, a smaller ratio of the igniter charge can be used because the travel time in the weapon barrel is longer and/or the projectile cavity can be wider.

For loading, a relatively volatile, anhydrous solvent is added to and thoroughly mixed with the base charge ingredients to provide a damp homogenous mixture thereof. While the solvent can be added during the initial mixing of the ingredients of the base charge, it preferably is added after the ingredients have been thoroughly mixed. Suitable solvents include methyl alcohol and other lower alcohols such as ethyl alcohol and isopropyl alcohol. The solvent dissolves the calcium resinate and promotes formation of a homogenous mixture with the calcium resinate binder substantially uniformally dispersed throughout.

The amount of solvent used preferably should not exceed that required to form a damp mixture which can be tamped into the projectile cavity by the application of a low pressure with a metal plunger or the like. If the base charge is too moist, proper loading and tamping is more difficult and a substantial longer drying time is required.

A sufficient amount of the same or similar anhydrous solvent is added to and mixed with the igniter charge to form a substantially homogenous mixture thereof. Preferably, enough solvent is added to provide a creamy-like consistency to facilitate addition to the projectile cavity as described in more detail below.

An appropriate amount of the damp base charge mixture to provide the desired trace distance (burn time) is first introduced into the projectile cavity. This amount varies as discussed above. As a guide, for a 9 mm projectile, the projectile cavity is partially filled (e.g., approximately 90%) with about 450 mg of the damp base charge mixture. The base charge is then tamped into the projectile cavity by the application of a low pressure less than about 2,000 psi, preferably hand-tamped with a metal plunger or a similar tool.

A sufficient amount of the igniter charge mixture to ignite the base charge upon firing the weapon is added on top of the base charge in the projectile cavity. In a preferred method, the remaining volume of the projectile cavity (e.g., approximately 10%) is filled by smearing about 50 mg of a creamy-like mixture of the igniter charge mixture into the projectile cavity on top of the base charge and removing any excess from the rear surface of the projectile.

The base charge and the igniter charge are then dried. If allowed to dry at room temperature under standard atmospheric conditions, this usually takes about 18 to about 24 hours. The drying time can be accelerated by blowing low-humidity, heated air or a substantially inert gas over loaded projectiles or by heating loaded projectiles in an oven or the like at an elevated temperature substantially below the ignition temperature of the igniter charge.

Strontium nitrate and magnesium readily absorb moisture from the air and the tracer unit can eventually become inoperative if not sealed against moisture absorption. If the ammunition is to be used within a relatively short time after the tracer unit has been loaded, it may not be necessary to provide protection against moisture absorption. When the ammunition is to be stored for some time, the exposed surface of the igniter charge (after drying) is coated with a compatible moisture proofing material. As used herein, the term "compatible" means a material which is substantially inert with respect to the ingredients of the igniter charge and will not substantially interfere with ignition of the igniter charge upon weapon firing.

Suitable moisture proofing materials include commercial quality white shellac containing 30.7% solids dissolved in 69.3% denatured alcohol and conforming to Federal Specification TT-S-300, nitrocellulose lacquer and similar products. In addition to providing a barrier against moisture absorption, the moisture proofing material can also promote hardening of the igniter charge.

The moisture proofing material can be applied in any suitable manner to provide a continuous coating over the exposed surface of the igniter charge, such as by brushing, spraying or the like.

After the moisture proofing material has dried, the projectile and cartridge or shell can be assembled for use.

The tracer unit of the invention has several advantages. It can be conveniently packed with very low pressure, such as by hand tamping, and still illuminate the trajectory of a projectile with a reddish-orange color for 200–300 yards or more. Use of low tamping pressures, rather than pressures of 30,000 psi or more required for conventional tracer compositions, significantly simplifies the loading operation. Also, small air spaces between the resulting loosely-packed grains of tracer ingredients promotes a more rapid ignition and propagation of flame through the charges. This ease of ignition permits the use of a base charge which burns at lower temperatures than conventional tracer compositions. The lower burning temperatures permit bursts of ammunition containing tracer units of the invention to be fired in automatic weapons without an excessive heat build-up. The tracer unit does not foul or damage the barrels of weapons in which it is fired. The tracer unit does not produce corrosive residues or toxic gases and does not damage, foul or reduce the effectiveness of fire arms equipped with silencers.

From the foregoing description, one skilled in the art can easily ascertain the essential characteristics of the invention and, without departing from the spirit and scope thereof, make various changes and modifications to adapt it to various usages.

We claim:

1. A tracer unit for ammunition comprising (a) a base charge including about 75 to about 90 weight % strontium peroxide, about 5 to about 15 weight % calcium resinate and about 5 to about 10 weight % magnesium; and (b) an igniter charge covering said base charge and including about 40 to about 60 weight % calcium resinate, about 20 to about 30 weight % stontium nitrate and about 20 to about 30 weight % magnesium.

2. A tracer composition according to claim 1 wherein the weight ratio of said igniter charge to said base charge is about 1:4 to about 1:20.

3. A tracer unit according to claim 1 wherein said base charge includes about 85 weight % strontium peroxide, about 9 weight % calcium resinate and about 6 weight % magnesium.

4. A tracer unit according to claim 1 wherein said igniter charge includes about 50 weight % calcium resinate, about 25 weight % strontium nitrate, and about 25 weight % magnesium.

5. A tracer unit according to claim 2 wherein the weight ratio of said igniter charge to said base charge is about 1:9.

6. A method for producing ammunition having a tracer unit including a base charge and an igniter charge for igniting the base charge when the weapon is fired, said method including the steps of:

(a) admixing a base charge including about 75 to about 90 weight % strontium peroxide, about 5 to about 15 weight % calcium resinate and about 5 to about 10 % magnesium with an anhydrous solvent to form a damp substantially homogenous mixture thereof:

(b) admixing an igniter charge including about 40 to 60 weight % calcium resinate, about 20 to about 30 weight % strontium nitrate and about 20 to about 30 weight % magnesium with an anhydrous solvent to form a substantially homogenous mixture thereof;

(c) partially filling a small cavity in the rear end of the ammunition projectile with a sufficient amount of the damp base charge mixture to illuminate the trajectory of the projectile for a desired distance when the weapon is fired;

(d) tamping the damp base charge mixture into the projectile cavity by the application of a low pressure; and (e) adding to the projectile cavity a sufficient amount of the igniter charge mixture to cover the base charge and to ignite the base charge when the weapon is fired.

7. A method according to claim 6 including the further steps of:

(f) drying the base and igniter charges; and (g) covering the exposed surfaces of the igniter charge with a compatible moisture proofing material.

8. A method according to claim 7 wherein the base charge includes about 85 weight % strontium peroxide, about 90 % calcium resinate and about 6 weight % magnesium.

9. A method according to claim 8 wherein the igniter charge includes about 50 weight % calcium resinate, about 25% strontium nitrate and about 25 weight % magnesium.

10. A method according to claim 6 wherein the weight ratio of the igniter charge to the base charge is about 1:4 to about 1:20.

11. A method according to claim 6 wherein a sufficient amount of the solvent is added to and mixed with the igniter charge to form the resulting mixture into a creamy-like consistency; and step (e) includes filling the unfilled portion of the projectile cavity with the creamy-like igniter charge mixture.

* * * * *